US012578101B2

(12) United States Patent
Fischer

(10) Patent No.: US 12,578,101 B2
(45) Date of Patent: Mar. 17, 2026

(54) APPARATUS AND SYSTEMS FOR ADAPTABLE CASSETTE HVAC BRACKET ASSEMBLY

(71) Applicant: GD Midea Air Conditioning Equipment Co., Ltd., Beijiao (CN)

(72) Inventor: Rick Fischer, Smithfield, KY (US)

(73) Assignee: Midea Group Co., Ltd., Beijiao (CN)

( * ) Notice: Subject to any disclaimer, the term of this patent is extended or adjusted under 35 U.S.C. 154(b) by 12 days.

(21) Appl. No.: 18/598,170

(22) Filed: Mar. 7, 2024

(65) Prior Publication Data

US 2025/0283611 A1 Sep. 11, 2025

(51) Int. Cl.
*F24F 1/0047* (2019.01)

(52) U.S. Cl.
CPC ..... *F24F 1/0047* (2019.02)

(58) Field of Classification Search
CPC ..... F24F 1/0047; F24F 1/0057; F24F 13/32
See application file for complete search history.

(56) References Cited

U.S. PATENT DOCUMENTS 1,254,706 A * 1/1918 Kurtzon ..... E01B 25/24 104/110
2,316,389 A * 4/1943 Atkinson ..... H02G 3/126 220/3.9
2,937,837 A * 5/1960 Johnson ..... H02G 3/125 248/300
4,271,751 A * 6/1981 Timmons ..... F24F 13/06 248/223.41
4,406,216 A 9/1983 Hott et al.
4,514,952 A * 5/1985 Johansson ..... E04D 3/362 52/713
4,690,359 A * 9/1987 Phillips ..... F16B 5/0225 248/300
4,957,251 A * 9/1990 Hubbard ..... F16L 3/22 248/300
5,222,800 A * 6/1993 Chan ..... F21V 21/048 362/147

(Continued)

FOREIGN PATENT DOCUMENTS

GB 2487759 A 8/2012
GB 2488100 A 8/2012

(Continued)

*Primary Examiner* — Eret C Mcnichols
(74) *Attorney, Agent, or Firm* — Dinsmore & Shohl LLP

(57) ABSTRACT

An HVAC cassette unit mounting bracket assembly includes a mounting bracket and a side panel. The mounting bracket includes a first leg and a second leg. The second leg includes one or more inner tabs and second leg holes. The side panel includes one or more first cutouts and first panel holes, one or more second cutouts and second panel holes. A bottom of each cutout is adjacent to a corresponding panel hole. Each first cutout is configured to receive an inner tab. The corresponding first panel hole is configured to be coupled to a second leg hole when the mounting bracket is mechanically coupled to a ceiling joist through ceiling drywall. Each second cutout is configured to receive an inner tab. The corresponding second panel hole is configured to be coupled to a second leg hole when the mounting bracket is mechanically coupled directly to the ceiling joist.

19 Claims, 6 Drawing Sheets

(56) References Cited

U.S. PATENT DOCUMENTS 5,240,342 A * 8/1993 Kresa, Jr. ..... F16B 9/058 403/403
5,366,194 A * 11/1994 Finney ..... F16M 13/022 396/428
5,908,263 A * 6/1999 Conners ..... E01F 9/559 362/153.1
6,241,206 B1 * 6/2001 Kam ..... H05K 7/1449 248/300
6,439,523 B1 * 8/2002 Chandler, Jr. ..... G02B 6/44526 248/300
6,904,730 B2 * 6/2005 Mitchell ..... E04D 3/363 52/545
7,375,922 B2 * 5/2008 Chen ..... G06F 1/184
7,478,508 B2 * 1/2009 Peterson ..... E04B 2/96 248/300
7,810,775 B2 * 10/2010 Dal Ponte ..... F21V 21/048 52/712
8,042,777 B2 * 10/2011 Ruiz ..... H02G 3/086 248/300
8,209,912 B2 * 7/2012 Hargreaves ..... A01G 9/249 52/28
8,535,128 B2 * 9/2013 Chwala ..... F24F 7/025 454/354
9,249,985 B2 * 2/2016 Cursetjee ..... F24F 13/28
9,696,021 B2 * 7/2017 Wronski ..... F21V 21/048
9,929,549 B2 * 3/2018 Witherbee ..... F16M 13/022
10,014,674 B1 * 7/2018 Illouz ..... H02G 3/12
10,184,644 B2 * 1/2019 Stathes ..... F21V 7/00
10,401,040 B2 * 9/2019 Kim ..... F24F 1/0057
10,508,445 B2 * 12/2019 Voellmecke, III ..... E04B 9/006
10,541,522 B2 * 1/2020 Lalancette ..... H02G 3/0456
10,648,695 B2 * 5/2020 Combs ..... F24F 13/084
10,712,046 B2 * 7/2020 Gao ..... F24F 13/32
10,850,818 B2 * 12/2020 Swift ..... B63H 20/06
10,907,843 B2 * 2/2021 Penlesky ..... F24F 7/06
11,175,023 B2 * 11/2021 Jones ..... F21S 8/026
11,933,038 B2 * 3/2024 Cost ..... E04B 1/388
2002/0050547 A1 * 5/2002 Medlin, Sr. ..... H02G 3/125 248/205.1
2010/0165646 A1 * 7/2010 Russo ..... F21S 8/02 362/147
2016/0305635 A1 * 10/2016 Stathes ..... F21V 17/101
2017/0229852 A1 * 8/2017 Jones ..... F16M 13/022
2019/0360501 A1 11/2019 Karst et al.

FOREIGN PATENT DOCUMENTS

JP H09-126542 5/1997
JP 2000274806 A 10/2000
WO WO2008126230 A1 10/2008

* cited by examiner

APPARATUS AND SYSTEMS FOR ADAPTABLE CASSETTE HVAC BRACKET ASSEMBLY

TECHNICAL FIELD

The present embodiments relate to cassette HVAC (heating, ventilation, and air conditioning) units mounted into a ceiling, particularly related to cassette HVAC units mounted to ceiling joists with or without ceiling drywall.

BACKGROUND

Many buildings use a central HVAC system with cassette units installed in the ceiling or attic to heat or cool specific areas. Installing these units can be a challenge because sometimes (such as in new installations) the units can be installed directly to ceiling joists, and the ceiling drywall is then installed afterward. In such new installations, a particular bracket can be used to install the cassette directly to the ceiling joists. But in other applications (such as existing or retrofit applications), the cassette units are installed after the ceiling drywall is already hung. In these retrofit applications, users must cut holes in the existing ceiling drywall, and, in order to use the same bracket as needed for a new installation, the user must cut the drywall wide enough to expose both ceiling joists. This means that the drywall section now has lost its support from these two adjacent ceiling joists, and the piece of ceiling drywall is therefore lacking support for a span of over 48 inches (for ceiling joists on 16-inch centers), which is not desirable. Accordingly, a need exists for a bracket assembly that can be used for both new installation and retrofit installation, that does not require ceiling drywall anchors to be removed from the two ceiling joists between which the cassette is installed.

SUMMARY

In some embodiments, a mounting bracket for installation of a ceiling cassette unit, the mounting bracket includes a first leg and a second leg. The first leg is configured to be mechanically coupled to a ceiling joist directly or through ceiling drywall. The second leg includes a first set of second leg holes and a second set of second leg holes. The first set of second leg holes and the second set of second leg holes are configured to be mechanically coupled to panel holes in a side panel attached to the ceiling cassette unit. The first leg and the second leg share a joint edge. The first set of second leg holes is configured to be coupled to the panel holes when the first leg is mechanically coupled to the ceiling joist through the ceiling drywall. The second set of second leg holes is configured to be coupled to the panel holes when the first leg is mechanically coupled directly to the ceiling joist.

In some embodiments, a mounting bracket assembly for installation of a ceiling cassette unit includes a mounting bracket and a side panel. The mounting bracket includes a first leg and a second leg. The first leg and the second leg share a joint edge. The second leg includes one or more inner tabs. Each inner tab includes one or more second leg holes. The side panel includes one or more first cutouts, one or more first panel holes, one or more second cutouts, and one or more second panel holes. A bottom of each one or more first cutouts is adjacent to a corresponding one or more first panel holes. A bottom of each one or more second cutouts is adjacent to a corresponding one or more second panel holes. Each first cutout is configured to receive one of the inner tabs and the corresponding first panel hole is configured to be coupled to one of the second leg holes when the mounting bracket is mechanically coupled to a ceiling joist through ceiling drywall. Each second cutout is configured to receive one of the inner tabs and the corresponding second panel holes are configured to be coupled to one of the second leg holes when the mounting bracket is mechanically coupled directly to the ceiling joist.

In some embodiments, a ceiling cassette unit assembly, mountable in an opening of a ceiling between a pair of ceiling joists, includes two or more mounting brackets, a housing, and a fan assembly. Each mounting bracket includes a first leg and a second leg. The first leg and the second leg share a joint edge. The second leg includes one or more inner tabs. Each inner tab includes one or more second leg holes. A housing includes first and second side panels, a front panel, and a rear panel, the first and second side panels configured to receive the mounting brackets. Each side panel includes one or more first cutouts, one or more first panel holes, one or more second cutouts, and one or more second panel holes. A bottom of each one or more first cutouts is adjacent to a corresponding one or more first panel holes. A bottom of each one or more second cutouts is adjacent to a corresponding one or more second panel holes. The fan assembly includes a fan and a motor in the housing. Each first cutout is configured to receive one of the inner tabs and the corresponding first panel hole is configured to be coupled to one of the second leg holes when the mounting bracket is mechanically coupled to the ceiling joist through ceiling drywall. Each second cutout is configured to receive one of the inner tabs and the corresponding second panel holes are configured to be coupled to one of the second leg holes when the mounting bracket is mechanically coupled directly to the ceiling joist.

These and additional features provided by the embodiments of the present disclosure will be more fully understood in view of the following detailed description, in conjunction with the drawings.

BRIEF DESCRIPTION OF THE DRAWINGS

The embodiments set forth in the drawings are illustrative and exemplary in nature and not intended to limit the disclosure. The following detailed description of the illustrative embodiments can be better understood when read in conjunction with the following drawings, wherein like structure is indicated with like reference numerals and in which.

DETAILED DESCRIPTION

Figure 1:
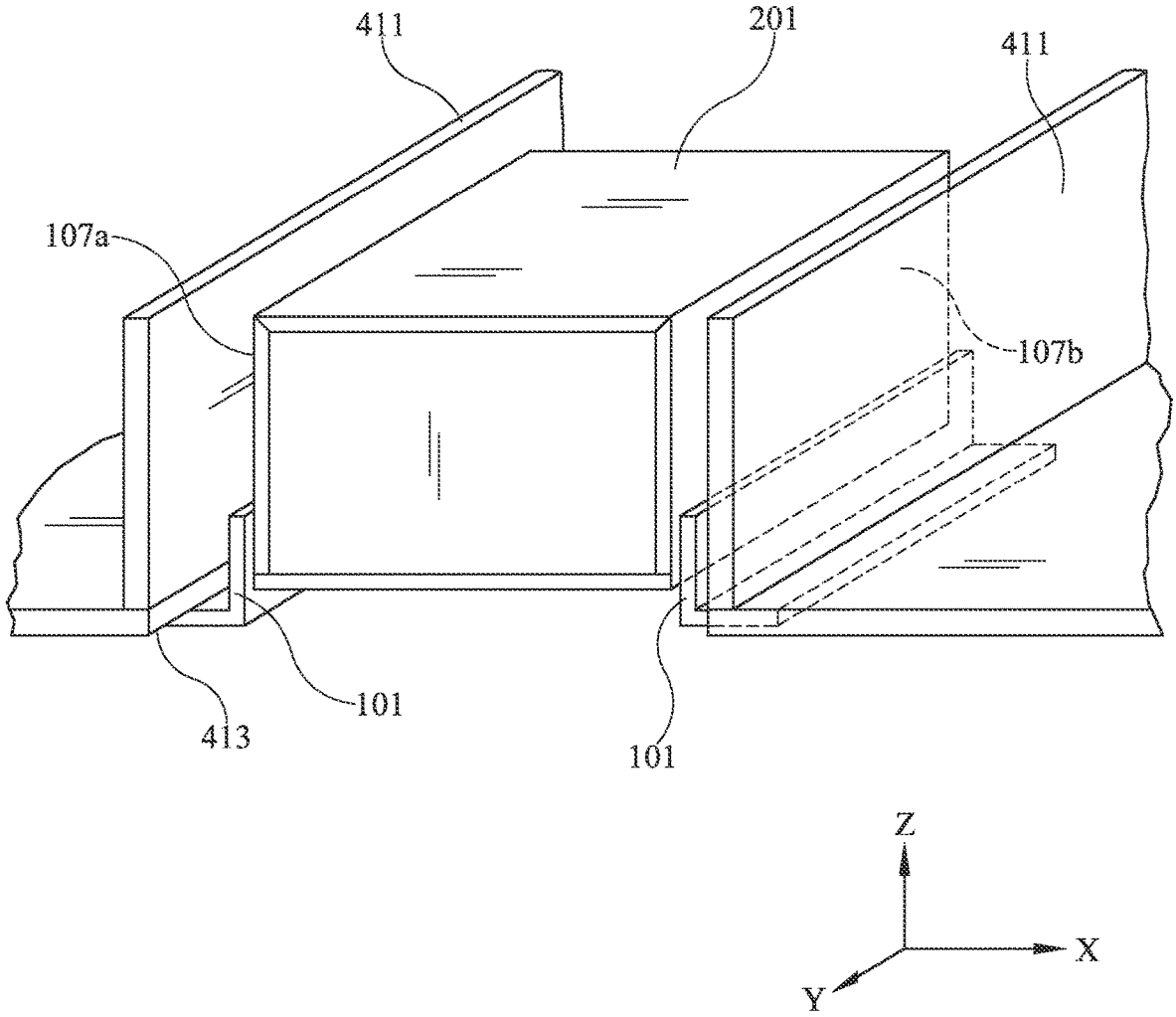
FIG. 1 is a schematic view of a mounted HVAC cassette unit using a mounting bracket assembly, according to one or more embodiments shown and described herein.

The embodiments described herein are directed to apparatus and systems for mounting bracket assemblies and ceiling cassette unit systems. The disclosed mounting bracket assembly may include a mounting bracket and a corresponding side panel of the cassette. The mounting bracket may include a first leg and a second leg. The first leg and the second leg may share a joint edge. The second leg may include one or more inner tabs. Each inner tab may include one or more second leg holes. The side panel may include one or more first cutouts and one or more first panel holes, and one or more second cutouts and one or more second panel holes. A bottom of each said one or more first cutouts may be adjacent to a corresponding one or more first panel holes. A bottom of each said one or more second cutouts may be adjacent to a corresponding one or more second panel holes. Each first cutout may be configured to receive one of the inner tabs and the corresponding first panel hole may be configured to be coupled to one of the second leg holes when the mounting bracket is mechanically coupled to ceiling drywall. Each second cutout may be configured to receive one of the inner tabs and the corresponding second panel holes may be configured to be coupled to one of the second leg holes when the mounting bracket is mechanically coupled to a ceiling joist directly.

Users installing cassette units using current mounting brackets encounter challenges when faced with differing types of installations. Standard brackets cannot adequately handle all types of installations. The bracket used for direct installation to the joists is not suitable for installing over drywall. Similarly, the bracket used for installing over drywall is not suitable for directly installing to the joists. This limitation necessitates multiple brackets, which increases cost, or requires project adjustments, potentially compromising the design or mandating additional support structures.

In contrast, the disclosed mounting bracket assemblies provide a solution for installing ceiling cassette units on joists in both types of installation scenarios: (a) directly to the ceiling joists in the absence of ceiling drywall (as seen in new construction) and (b) to the ceiling joists through existing ceiling drywall. This design streamlines the installation process, eliminating the need for a separate bracket, additional materials, and removing too much drywall. This adaptability not only simplifies installation but also enhances efficiency, reducing the reliance on various bracket designs or intricate adjustments. The mounting bracket assemblies offer flexible options for installation, enabling both new installations and retro-fit installations using a single bracket. As such, using the mounting brackets described herein can reduce installation time and prevent the need for removing the drywall anchors that are already inserted into the ceiling joists.

The embodiments discussed hereinafter will focus on the implementation of the hereinafter-described techniques and apparatus within a residential, commercial, and/or building structure, such as the type that may be used in single-family or multi-family dwellings, or in other similar applications. However, it will be appreciated that the herein-described techniques and apparatus may also be used in connection with other types of building structures in some embodiments. For example, the herein-described techniques may be used in commercial applications in some embodiments. Moreover, for example, the cassette HVAC units mounted in a ceiling may be a four-way cassette or two-way cassette in some embodiments. Similarly, the particulars of the HVAC cassette 201 will not be described in detail, as this disclosure relates to the mounting of such units, rather than the internal operation of such units. Therefore, many features of such units will not be described in detail (such as, for example, a fan, a fan motor, evaporator coils, condensate pump, controls, conduits, and the like), it being understood that the teachings of this disclosure apply to many types of HVAC cassette units.

Figure 2A:
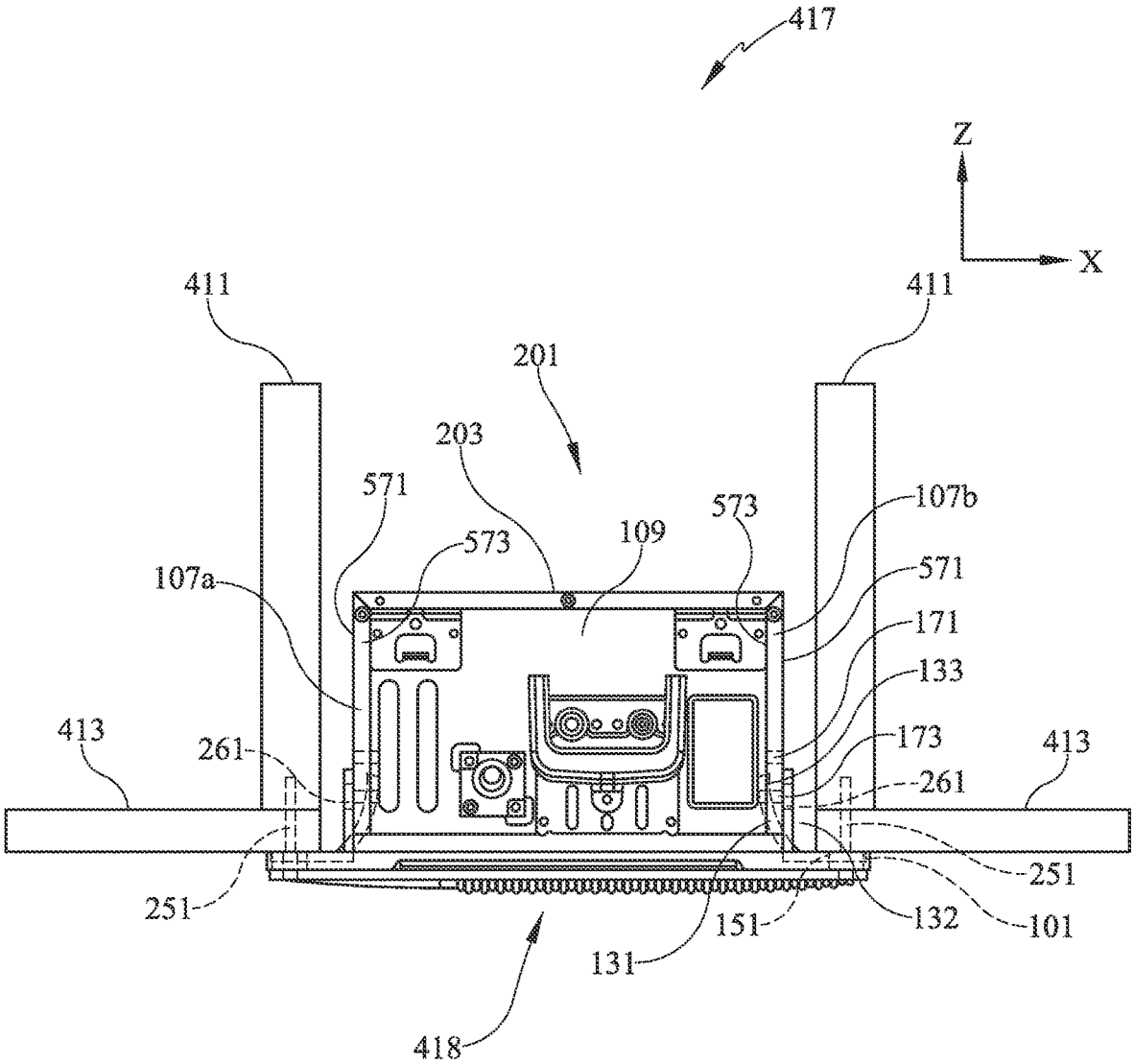
FIG. 2A is a section view of an example mounting bracket assembly with a cassette unit installation shown mounted to ceiling joists through ceiling drywall, according to one or more embodiments shown and described herein.
Figure 2B:
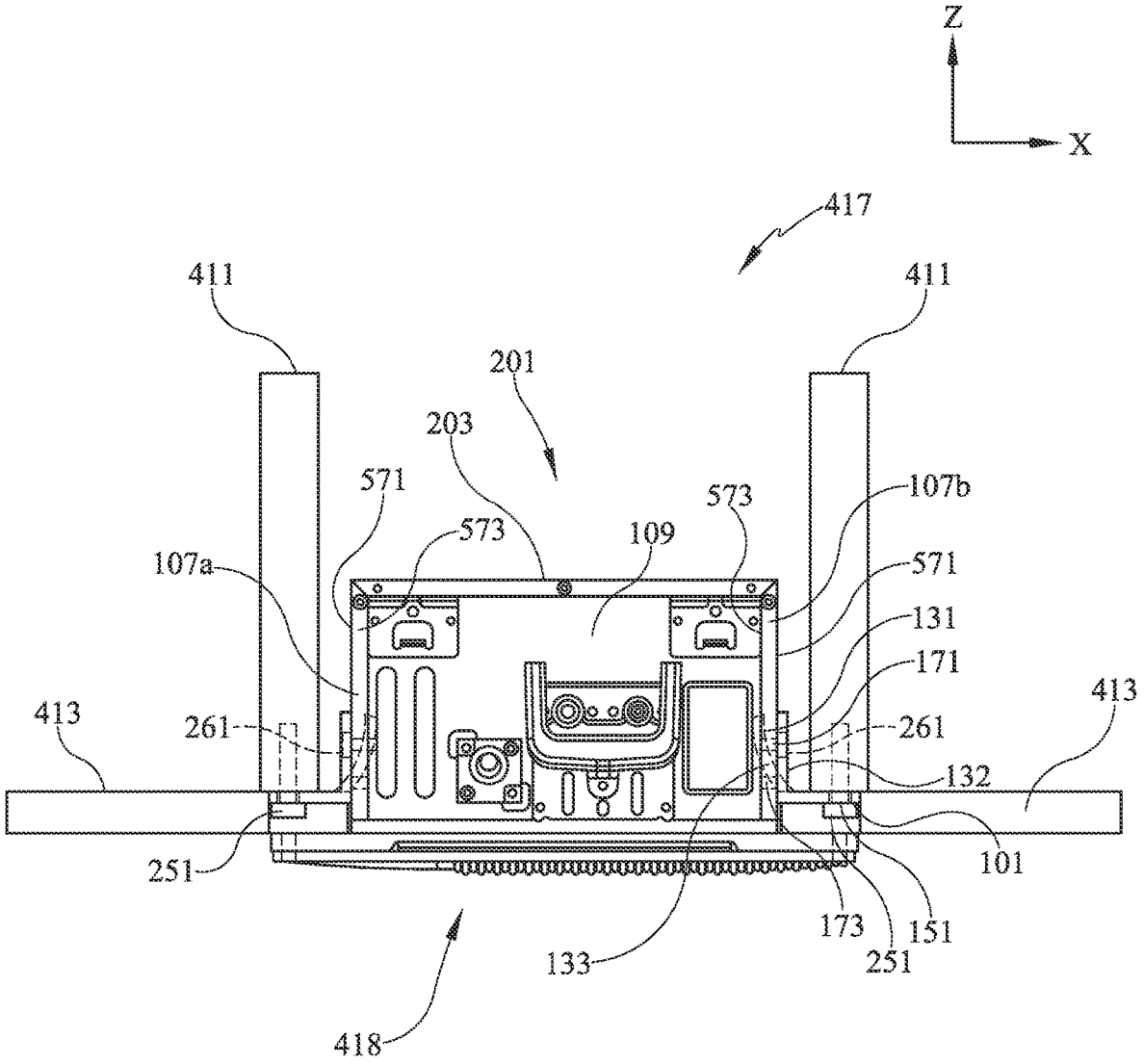
FIG. 2B is a section view of the example mounting bracket assembly and cassette unit of FIG. 2A, shown mounted directly to ceiling joists, according to one or more embodiments shown and described herein.

Referring now to figures, FIG. 1 generally depicts an HVAC cassette unit 201 installed in a spacing 417 between two parallel ceiling joists 411. FIG. 2A depicts a retro-fit installation, where the HVAC cassette unit 201 is fastened to the ceiling joists 411 through drywall 413. FIG. 2B depicts a new installation, where the HVAC cassette unit 201 is fastened to the ceiling joists 411 directly.

The HVAC cassette unit 201 includes a housing 203 to hold different components of the HVAC cassette unit 201. The housing 203 may include side panels 107 (e.g., a first side panel 107*a* and a second side panel 107*b*), a front panel 109, and a rear panel. The side panels 107 work in conjunction with a mounting bracket (described below) to enable the HVAC cassette unit 201 to be directly mounted on the ceiling joists 411 (e.g., as in FIG. 2B) or indirectly through the ceiling drywall 413 (e.g., as illustrated in FIG. 2A) through mechanical coupling with one or more of mounting brackets 101.

In typical installations, the ceiling joists 411 are spaced from each other to define a spacing 417 therebetween. The spacing 417 between two parallel ceiling joists 411 allows a HVAC cassette unit 201 to be secured to the ceiling joists 411 within the spacing 417. Spacing 417 can be any spacing, such as common spacings like on-center spans of 12 inches, 16 inches, 24 inches, and the like. In new installations of HVAC cassette unit 201, often there is no drywall 413 present, so the HVAC cassette unit 201 is installed directly to the ceiling joists 411, as will be described below and as shown in FIG. 2B. In retro-fit installations, ceiling drywall 413 may be present, such that a ceiling drywall opening 418 must be created in order to install the HVAC cassette unit 201. The mounting bracket assembly 100 described herein enables a smaller ceiling drywall opening 418 to be used to mount the HVAC cassette unit 201, as compared to prior art brackets (which require the ceiling drywall opening 418 to expose not only the ceiling joist spacing 417, but also the width of both ceiling joists 411). As will be described, the mounting bracket assembly 100 advantageously enables a user to cut the drywall opening 418 to match the ceiling joint spacing 417, thus allowing the ceiling drywall fasteners beneath the ceiling joists 411 to remain in place.

Figure 3:
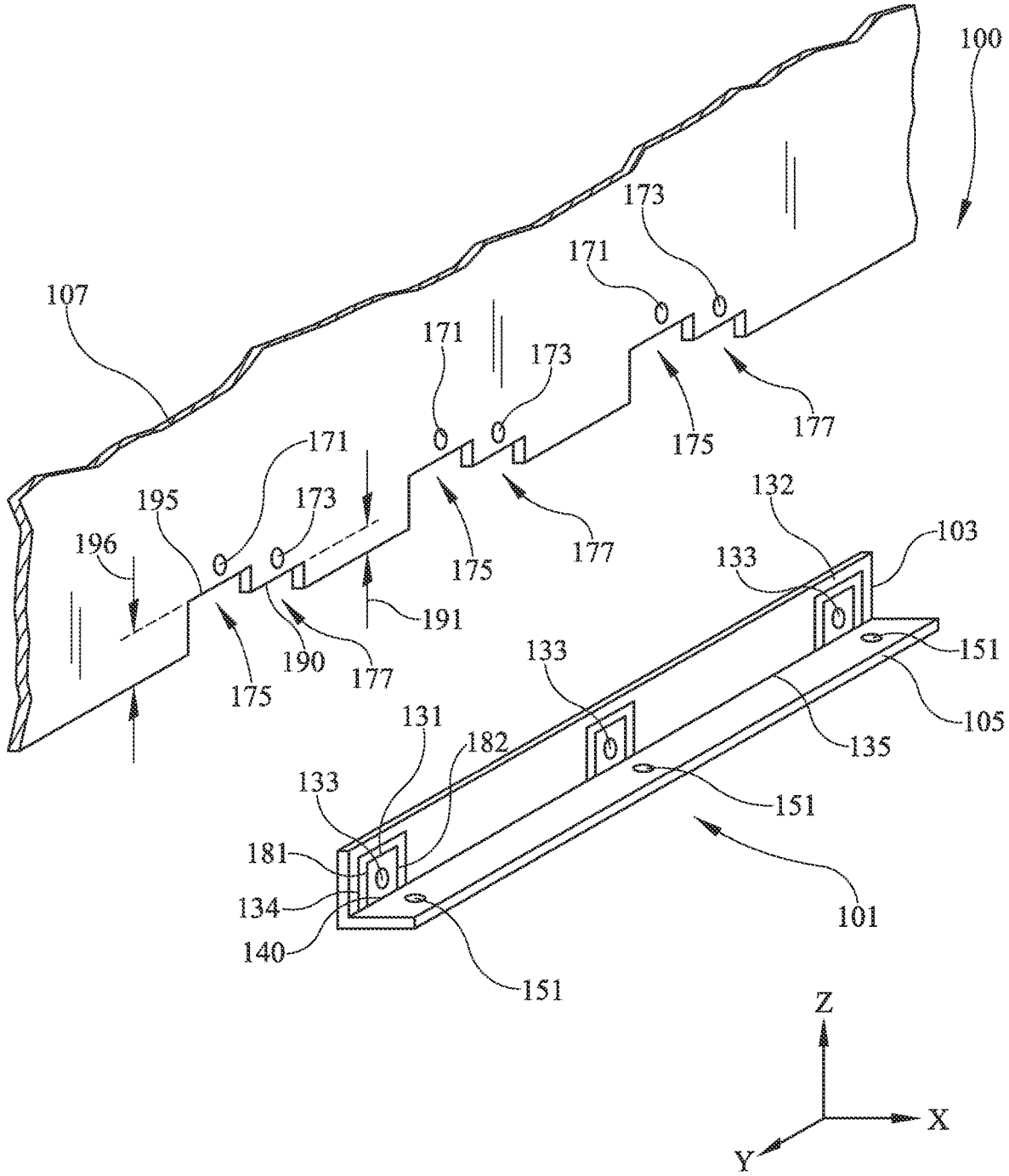
FIG. 3 is a schematic view of an example mounting bracket assembly for cassette unit installation, according to one or more embodiments shown and described herein.

FIG. 3 illustrates a mounting bracket 101 that enables both new and retro-fit installations. The mounting bracket 101 includes a first leg 105 and a second leg 103. The first leg 105 and the second leg 103 may share a joint edge 135. The first leg 105 may be configured to be mechanically coupled to a ceiling joist 411 either directly or through the ceiling drywall 413. The second leg 103 may be configured to be mechanically coupled to the side panel 107 of the HVAC cassette unit 201. The first leg 105 may include attachment mechanisms to allow the mounting bracket 101 to be configured to engage with the ceiling joist 411 directly or through the ceiling drywall 413. For example, the first leg 105 may include a set of first leg holes 151. A first set of fasteners 251, for example, can be inserted through the first leg holes 151 and into the ceiling joists 411 (directly (FIG. 2B) or through the ceiling drywall 413 (FIG. 2A)).

Figure 4A:
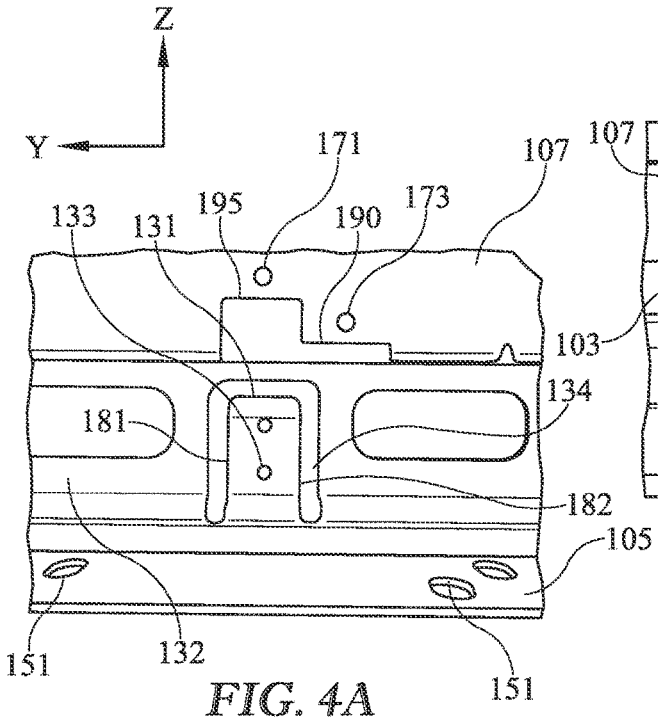
FIG. 4A is a front view of a portion of an example mounting bracket assembly for cassette unit installation, shown disengaged from a side panel, according to one or more embodiments shown and described herein.
Figure 4B:
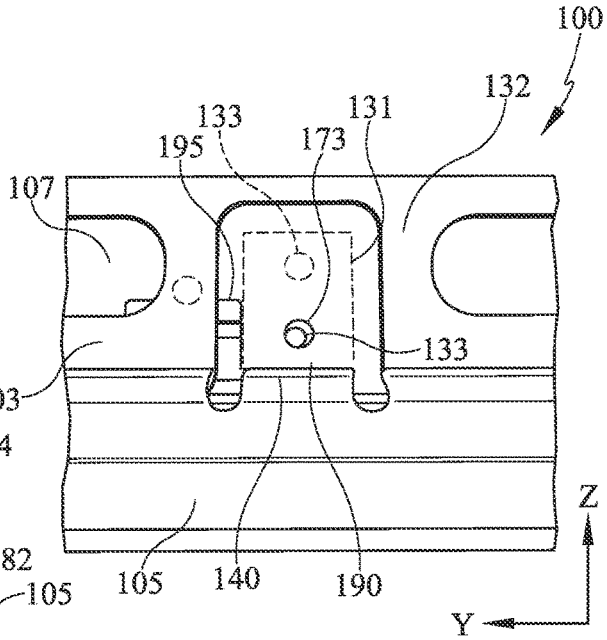
FIG. 4B is a front view of a portion of an example mounting bracket assembly for cassette unit installation, shown engaged with a side panel, according to one or more embodiments shown and described herein.
Figure 4C:
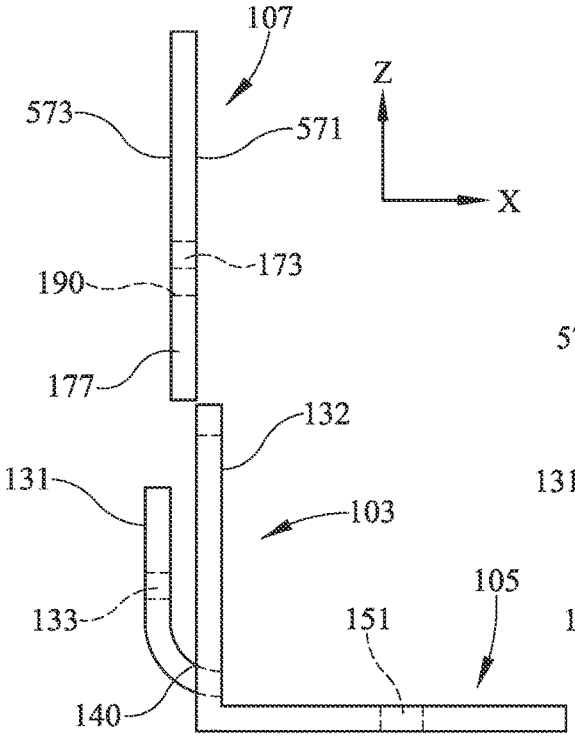
FIG. 4C is a section view of a portion of an example mounting bracket assembly for cassette unit installation, shown disengaged from a side panel, according to one or more embodiments shown and described herein.

In some embodiments, the second leg 103 may include a set of inner tabs 131 extending from near the joint edge 135 away from the first leg 105 in the z-direction as shown in FIG. 3. The inner tabs 131 may be at least partially circumscribed within a surface 132 of the second leg 103. Two or more extended edges 181, 182 of each inner tab 131 have a gap 134 between the surface 132 and each respective extended edge 181, 182, such that the gap 134 between the inner tabs 131 and the surface 132 is in an upside-down U-shape (e.g., as illustrated in FIGS. 3-4B). Alternatively, the inner tab 131 may be triangular in shape, such that the two extended edges 181, 182 are angled towards each other, in order to create an upside-down V-shape gap 134 between the surface 132 and each extended edge 181, 182, respectively). The inner tabs 131 have a bottom portion 140 that is configured to mechanically couple with various cutouts 175, 177 in the side panel 107 (described below) to mechanically couple the HVAC cassette unit 201 to the mounting bracket 101.

Figure 4D:
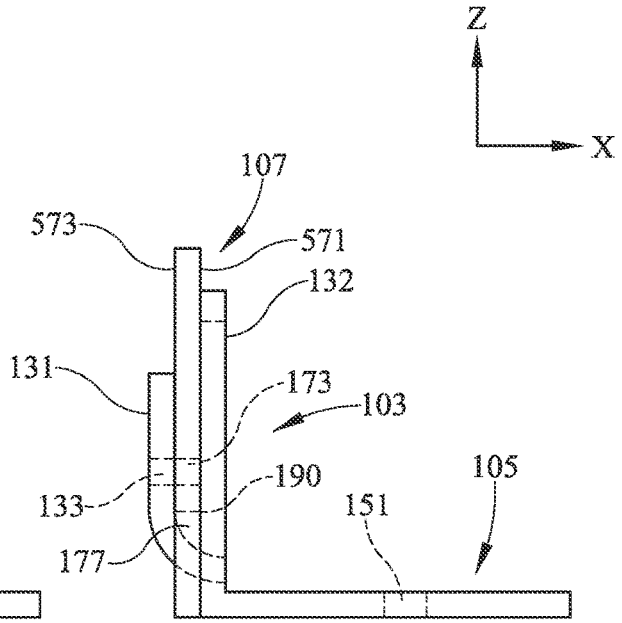
FIG. 4D is a section view of a portion of an example mounting bracket assembly for cassette unit installation, shown engaged with a side panel, according to one or more embodiments shown and described herein.

With reference to FIGS. 3-4D, each inner tab 131 may also include one or more second leg hole 133 (e.g., as illustrated in FIG. 4A-4D). The second leg holes 133 may be configured to be aligned with a set of panel holes 171 and 173 of the side panel 107. In some embodiments, a second set of fasteners 261 may inserted through the second leg holes 133 and into the panel holes 171 and 173 such that the second leg 103 is additionally mechanically attached to the side panel 107 via second set of fasteners 261. The panel holes 171 and 173 may include bosses. For example, the panel holes 171 and 173 may include threaded bosses and the second set of fasteners 261 may be threadedly coupled to the threaded bosses.

As discussed, the side panel 107 may include a set of first cutouts 177, a set of first panel holes 173, a set of second cutouts 175, and a set of second panel holes 171. The set of first cutouts 177 may have a bottom 190. The bottom 190 is located at a given depth 191 from a lower edge of the side panel 107. The set of second cutouts may have a bottom 195. The bottom 195 is located at a given depth 196 from the lower edge of the side panel 107. The set of first panel holes 173 is located adjacent the bottom 190. The set of second panel holes 171 is located adjacent the bottom 195. For example, as illustrated in FIG. 3-4D, each set of first panel holes 173 may be positioned above the bottom of a corresponding first cutout 177 in the z-direction of the coordinate, and each set of second panel holes 171 may be positioned above the bottom of a corresponding second cutout 175 in the z-direction of the coordinate. The distances between the bottoms 190, 195 of the cutouts 177, 175, respectively, and their corresponding panel holes 173, 171 may be approximately equal to or less than distances between the second leg holes 133 to the joint edge 135.

In some embodiments, as illustrated in FIG. 3, the depth 191 of the first cutout 177 may be less than the depth 196 of the second cutout 175. The depth difference between the first cutouts 177 and the second cutouts 175 may be approximately equal to a thickness of the ceiling drywall 413. The first cutout 177 may be adjacent to the second cutout 175 in the y-direction of the coordinate such that a left edge of the first cutout 177 is shared as a right edge of the second cutout 175. As such, a neighboring first cutout 177 and a neighboring second cutout 175 may merge into a continuous cutout with shared edge.

With continued reference to FIGS. 2A-4D, the inner tabs 131 and the second leg holes 133 may be configured to be mechanically coupled to the first cutouts 177 and the first panel holes 173 of the side panel 107, respectively, when the first leg 105 is mechanically coupled through the ceiling drywall 413. Alternatively, the inner tabs 131 and the second leg holes 133 may be configured to be mechanically coupled to the second cutouts 175 and the second panel holes 171 of the side panel 107, respectively, when the first leg 105 is mechanically coupled directly to the ceiling joists 411. For example, as illustrated in FIGS. 3-4D, each first cutout 177 is configured to receive one of the inner tabs 131, and the corresponding first panel hole 173 is configured to be coupled to one of the second leg holes 133 within the corresponding inner tab 131 when the mounting bracket 101 is mechanically coupled to the ceiling joists 411 through the ceiling drywall 413 (e.g., as illustrated in FIG. 2B). Alternatively, as illustrated in FIGS. 3-4D, each second cutout 175 is configured to receive one of the inner tabs 131 and the corresponding second panel hole 171 is configured to be coupled to one of the second leg holes 133 within the corresponding inner tab 131 when the mounting bracket 101 is mechanically coupled directly to the ceiling joists 411 (e.g., as illustrated in FIG. 2A). The cutouts 175 and 177 may be configured to receive the inner tabs 131 to allow the inner tabs 131 to insert behind the side panel 107 such that an inner surface 573 of the side panel 107 mechanically contacting with the inner tabs 131 and the rest part of the second leg 103 (i.e., the surface 132 of the second leg 103) contact with the outer surface 571 of the side panel 107. Accordingly, the inner tabs 131 and the surface 132 of the second leg 103 may sandwich the side panel 107 in between in a side view of the mounting bracket assembly 300 (e.g., as illustrated in FIG. 4D). In some embodiments, the inner tabs 131 may be inserted behind the side panel 107 until the bottom 190, 195 of the cutouts 177 and 175 are mechanically coupled to a portion of the inner tabs 131, such as the bottom portion 140 of the inner tabs 131. In some embodiments, the inner tabs 131 may be inserted behind the side panel 107 to the extent of allowing the first panel holes 173 or the second panel holes 171 to match with the second leg holes 133, respectively.

As discussed, the mounting bracket assembly 100 enables a user to mount the HVAC cassette unit 201 within the opening 418 directly to the ceiling joists 411 before installing the ceiling drywall 413 or, alternatively, to ceiling joists 411 after ceiling drywall 413 has been installed, by cutting an opening 418 in the drywall 413 that is approximately the same width as the spacing 417. In either scenario, the first side panel 107*a* and the second side panel 107*b* are configured to be engaged with the inner tabs 131 in the inner surface 573 such that either the bottom 190 of the first cutouts 177 or the bottom 195 of the second cutouts 175 are mechanically coupled to a bottom portion 140 of the inner tabs 131. The design of the mounting bracket assembly 100 allows the mounting bracket 101, without being fully disengaged from the side panel 107, to have its second leg 103 selectively moved to couple to either the first cutouts 177 or the second cutouts 175. For example, a user may continuously move and slide the mounting bracket 101 within the in-plane directions (e.g., the y-direction in the coordinate of FIGS. 3-5B) with the inner tabs 131 behind the side panel 107 (e.g., the inner tabs 131 continuously contacting the inner surface 573 of the side panel 107).

In retro-fit installations (FIG. 2A), the inner tab 131 of the mounting brackets 101 may be inserted behind the first side panel 107*a* and the second side panel 107*b* to contact with the inner surface 573 of the side panels 107 such that the second leg hole 133 of the mounting bracket 101 matches the first panel hole 173 to allow the second set of fasteners 261 to secure the mounting bracket 101 relative to the HVAC cassette unit 201. Further, the first leg hole 151 can be configured to be mechanically coupled to the ceiling joists 411 through the ceiling drywall 413 to secure the mounting bracket 101 related to the ceiling joists 411. Accordingly, the HVAC cassette unit 201 is mounted to the ceiling joists 411.

Alternatively, in new installations (FIG. 2B), the inner tab 131 of the mounting brackets 101 may be inserted behind the first side panel 107*a* and the second side panel 107*b* to contact with the inner surface 573 of the side panels 107 such that the second leg hole 133 of the mounting bracket 101 matches the second panel hole 171 to allow the second set of fasteners 261 to secure the mounting bracket 101 relative to the HVAC cassette unit 201. Further, the first leg hole 151 is configured to be mechanically coupled to the ceiling joists 411 through the ceiling drywall 413 to secure the mounting bracket 101 related to the ceiling joists 411. Accordingly, the HVAC cassette unit 201 is mounted to the ceiling joists 411. The ceiling drywall 413 with the opening 418 may be then installed to have the bottom of the ceiling joists 411 covered such that the ceiling drywall 413 may be screwed to the ceiling joists 411.

It should be appreciated that in alternative embodiments, some of the mechanical structures of the side panel 107 and the mounting bracket 101 may be exchangeable. For example, the second leg 103 may include cutouts while the side panel 107 may include inner tabs, in a manner similar to that described above.

Figure 5:
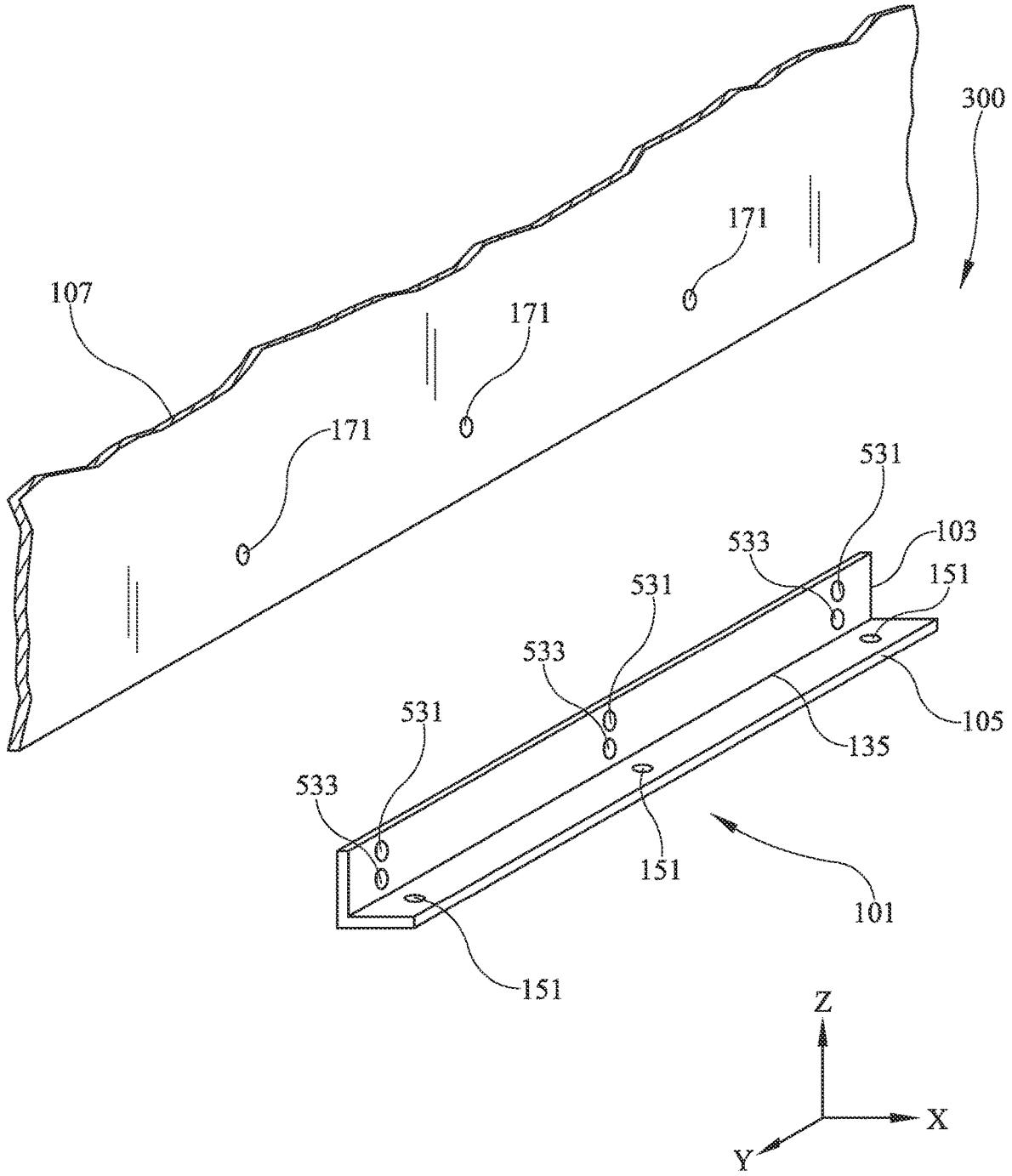
FIG. 5 is a schematic view of an example mounting bracket assembly for cassette unit installation, in accordance with one or more embodiments shown and described herewith.

Referring now to FIG. 5, an alternative embodiment of a mounting bracket assembly 300 for installation of the HVAC cassette unit 201 is depicted. The mounting bracket 101 may include a first leg 105 and a second leg 103. The first leg 105 and the second leg 103 may share a joint edge 135. The first leg 105 may be configured to be mechanically coupled to a ceiling joist 411 either directly or through the ceiling drywall 413. The second leg 103 may be configured to be mechanically coupled to the side panel 107. The second leg 103 may include a first set of second leg holes 531 and a second set of second leg holes 533.

The first set of second leg holes 531 may be above the second set of second leg holes 533 in the z-direction as shown in FIG. 5. The distance between the first set of second leg holes 531 and the second set of second leg holes 533 may be essentially equal to or more than a thickness of ceiling drywall 413. In some embodiments, a first distance between the first set of second leg holes 531 and the joint edge 135 is less than a second distance between the second set of second leg holes 533 and the joint edge 135. The difference between the first distance and the second distance is essentially equal to or more than a thickness of the ceiling drywall 413. The first leg 105 may include attachment mechanisms, such as a set of first leg holes 151. The attachment mechanisms such as the first leg holes 151 are configured to attach the first leg 105 to the ceiling joists 411 either directly or through the ceiling drywall 413. The side panel 107 of the mounting bracket assembly 300 may include a set of panel holes 171. The first set of second leg holes 531 and the second set of second leg holes 533 may be configured to be mechanically coupled to the set of panel holes 171 of the side panel 107. In some embodiments, a second set of fasteners 261 may inserted through the first set of second leg holes 531 or the second set of second leg holes 533 to further mate with the set of panel holes 171 such that the second leg 103 is mechanically attached to the side panel 107. The set of panel holes 171 may include bosses. For example, the panel holes 171 may include threaded bosses and the second set of fasteners 261 may be threadedly coupled to the threaded bosses.

Similar to FIGS. 2A-2B, a user may decide to mount the HVAC cassette unit 201 to the ceiling joists 411 directly or through the ceiling drywall 413 through the mounting bracket assembly 300. For example, the HVAC cassette unit 201 may be mounted or secured through the ceiling drywall 413 by inserting first set of fasteners 251 through the set of first leg holes 151 and into the ceiling joists 411. The mounting bracket 101 is mounted to the HVAC cassette unit 201 by inserting second set of fasteners 261 through the first set of second leg holes 531 and through the set of panel holes 171. Alternatively, the HVAC cassette unit 201 may be mounted or secured to the ceiling joists 411 directly by inserting first set of fasteners 251 through the set of first leg holes 151 and into the ceiling joists 411. The mounting bracket 101 is mounted to the HVAC cassette unit 201 by inserting second set of fasteners 261 through the second set of second leg holes 533 and through the set of panel holes 171.

In some embodiments, a method of installation of the HVAC cassette unit 201 including the mounting bracket 101 and the side panels 107 may include determining whether ceiling drywall 413 is installed. In new installations, or where ceiling drywall 413 is not installed, the method includes inserting the inner tabs 131 of the second leg 103 to the second cutouts 175 to mechanically couple the second leg holes 133 with the second panel holes 171. The method may include arranging the HVAC cassette unit 201 between a pair of ceiling joists 411. The method may include mechanically coupling the first leg 105 directly to the ceiling joists 411.

In some embodiments, the method of installation of the HVAC cassette unit 201 includes determining the ceiling drywall 413 is already installed. In this case a ceiling drywall opening 418 is created to open the ceiling drywall to a width that approximately matches spacing 417. The method includes inserting the inner tabs 131 of the second leg 103 to the first cutouts 177 to mechanically couple the second leg holes 133 with the first panel holes 173. The method may include arranging the HVAC cassette unit 201 between a pair of ceiling joists 411 through the opening 418. The method may include mechanically coupling the first leg 105 to the ceiling joists 411 through the ceiling drywall 413.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined. The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

It is to be understood that the embodiments are not limited in their application to the details of construction and the arrangement of components set forth in the description or illustrated in the drawings. The invention is capable of some embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

What is claimed is:

1. A mounting bracket for installation of a ceiling cassette unit, the mounting bracket comprising:

a first leg configured to be mechanically coupled to a ceiling joist directly or through ceiling drywall;

a second leg comprising a first set of second leg holes and a second set of second leg holes, said first set of second leg holes and said second set of second leg holes configured to be mechanically coupled to panel holes in a side panel attached to the ceiling cassette unit, wherein:

the first leg and the second leg share a joint edge;

the first set of second leg holes is configured to be coupled to the panel holes when the first leg is mechanically coupled to the ceiling joist through the ceiling drywall;

the second set of second leg holes is configured to be coupled to the panel holes when the first leg is mechanically coupled directly to the ceiling joist;

the second leg further comprises one or more inner tabs extending from near the joint edge between the first leg and the second leg away from the first leg; and two or more extended edges of each inner tab has a gap between a plate structure of the second leg and the inner tab, wherein the gap is a U-shape gap or a V-shape gap.

2. The mounting bracket of claim 1, wherein one or more holes of the first set of second leg holes or of the second set of the second leg holes is positioned in each inner tab.

3. The mounting bracket of claim 1, wherein the inner tabs are configured to contact an inner surface of the side panel when a plate of the second leg contacts an outer surface of the side panel.

4. The mounting bracket of claim 1, wherein the inner tabs are substantially within the plate structure of the second leg.

5. The mounting bracket of claim 1, wherein the first leg comprises a set of first leg holes configured to engage with a fastener to mechanically couple the first leg to the ceiling joist or the ceiling drywall.

6. The mounting bracket of claim 1, wherein the first leg is configured to be mechanically coupled to the ceiling joist through the ceiling drywall such that the ceiling drywall is mechanically coupled to the ceiling joist.

7. The mounting bracket of claim 1, wherein a first distance between the first set of second leg holes and the joint edge is less than a second distance between the second set of second leg holes and the joint edge.

8. The mounting bracket of claim 7, wherein a difference between the first distance and the second distance is accommodated according to the ceiling drywall.

9. A mounting bracket assembly for installation of a ceiling cassette unit comprising:

a mounting bracket comprising a first leg and a second leg, wherein:

the first leg and the second leg share a joint edge;

the second leg comprises one or more inner tabs; and each inner tab comprises one or more second leg holes;

a side panel comprising:

one or more first cutouts and one or more first panel holes, wherein a bottom of each said one or more first cutouts is adjacent to a corresponding one or more first panel holes;

one or more second cutouts and one or more second panel holes, wherein a bottom of each said one or more second cutouts is adjacent to a corresponding one or more second panel holes, wherein:

each said first cutout is configured to receive one of the inner tabs and the corresponding first panel hole is configured to be coupled to one of the second leg holes when the mounting bracket is mechanically coupled to a ceiling joist through ceiling drywall; and each said second cutout is configured to receive one of the inner tabs and the corresponding second panel holes are configured to be coupled to one of the second leg holes when the mounting bracket is mechanically coupled directly to the ceiling joist.

10. The mounting bracket assembly of claim 9, wherein an inner surface of the side panel is configured to contact the inner tab, and an outer surface of the side panel is configured to contact a plate structure of the mounting bracket.

11. The mounting bracket assembly of claim 9, wherein the bottom of each first cutout and the bottom of each second cutout are configured to be mechanically coupled to a portion of one of the inner tabs.

12. The mounting bracket assembly of claim 9, wherein the first cutouts have a depth less than the second cutouts.

13. The mounting bracket assembly of claim 12, wherein a depth difference between the first cutouts and the second cutouts is accommodated according to the ceiling drywall.

14. A ceiling cassette unit assembly, mountable in an opening of a ceiling between a pair of ceiling joists, comprising:

two or more mounting brackets, each mounting bracket comprising a first leg and a second leg, wherein:

the first leg and the second leg share a joint edge;

the second leg comprises one or more inner tabs; and each inner tab comprises one or more second leg holes;

a housing comprising first and second side panels, a front panel, and a rear panel, the first and second side panels configured to receive the mounting brackets, each side panel comprising:

one or more first cutouts and one or more first panel holes, wherein a bottom of each said one or more first cutouts is adjacent to a corresponding one or more first panel holes;

one or more second cutouts and one or more second panel holes, wherein a bottom of each said one or more second cutouts is adjacent to a corresponding one or more second panel holes;

a fan assembly comprising a fan and a motor in the housing; and wherein:

each said first cutout is configured to receive one of the inner tabs and the corresponding first panel hole is configured to be coupled to one of the second leg holes when the mounting bracket is mechanically coupled to the ceiling joist through ceiling drywall; and each said second cutout is configured to receive one of the inner tabs and the corresponding second panel holes are configured to be coupled to one of the second leg holes when the mounting bracket is mechanically coupled directly to the ceiling joist.

15. The ceiling cassette unit assembly of claim 14, wherein the first leg of each mounting bracket is configured to be mechanically coupled to one of the ceiling joists before the ceiling drywall is installed.

16. The ceiling cassette unit assembly of claim 14, wherein the inner tabs are substantially within a plate structure of the second leg, wherein two or more extended edges of each inner tab has a gap between the plate structure, wherein the gap is a U-shape gap or a V-shape gap.

17. The ceiling cassette unit assembly of claim 14, wherein the side panel is configured to be engaged with the inner tab in an inner surface of the side panel.

18. The ceiling cassette unit assembly of claim 14, wherein the bottom of each first cutout and the bottom of each second cutout are configured to be mechanically coupled to a bottom portion of the inner tab.

19. The ceiling cassette unit assembly of claim 14, wherein the first cutouts have a depth less than the second cutouts, and a depth difference between the first cutouts and the second cutouts is accommodated according to the ceiling drywall.

* * * * *